US012059032B2

(12) United States Patent
Liu et al.

(10) Patent No.: US 12,059,032 B2
(45) Date of Patent: Aug. 13, 2024

(54) ELECTRIC HEATING CIGARETTE APPLIANCE HAVING TEMPERATURE AND PERIOD ADJUSTMENT FUNCTIONS

(71) Applicant: CHINA TOBACCO HUBEI INDUSTRIAL CORPORATION LIMITED, Wuhan (CN)

(72) Inventors: Huachen Liu, Wuhan (CN); Yikun Chen, Wuhan (CN); Chenghao Luo, Wuhan (CN); Bing Liu, Wuhan (CN); Lei Liu, Wuhan (CN)

(73) Assignee: CHINA TOBACCO HUBEI INDUSTRIAL CORPORATION LIMITED, Wuhan (CN)

( * ) Notice: Subject to any disclaimer, the term of this patent is extended or adjusted under 35 U.S.C. 154(b) by 873 days.

(21) Appl. No.: 17/261,887

(22) PCT Filed: Jul. 23, 2018

(86) PCT No.: PCT/CN2018/096670
§ 371 (c)(1),
(2) Date: Jul. 22, 2021

(87) PCT Pub. No.: WO2020/019122
PCT Pub. Date: Jan. 30, 2020

(65) Prior Publication Data

US 2021/0345671 A1 Nov. 11, 2021

(51) Int. Cl.

| | |
|---|---|
| ***A24F 40/95*** | (2020.01) |
| ***A24F 40/46*** | (2020.01) |
| ***A24F 40/57*** | (2020.01) |
| ***A24F 40/60*** | (2020.01) |

(52) U.S. Cl.
CPC ..... *A24F 40/46* (2020.01); *A24F 40/57* (2020.01); *A24F 40/60* (2020.01); *A24F 40/95* (2020.01)

(58) Field of Classification Search
None
See application file for complete search history.

(56) References Cited

U.S. PATENT DOCUMENTS

2018/0132526 A1 5/2018 Davis et al.

FOREIGN PATENT DOCUMENTS

| | | | | |
|---|---|---|---|---|
| CN | 203676124 U | | 7/2014 | |
| CN | 203986136 | | 12/2014 | |
| CN | 204120235 U | * | 1/2015 | |
| CN | 105595422 | | 5/2016 | |
| CN | 106028846 A | * | 10/2016 | ..... A24B 15/167 |

(Continued)

OTHER PUBLICATIONS

Search Report for International Patent Application PCT/CN2018/096670, mailed on Jan. 30, 2020.

*Primary Examiner* — Tho D Ta
(74) *Attorney, Agent, or Firm* — Fresh IP PLC; Clifford D. Hyra; Aubrey Y. Chen

(57) ABSTRACT

The present disclosure provides an electric heating cigarette appliance, including a power supply for providing power to a heating device, a heating device connected to the power supply, and a controller for controlling a temperature of the heating device at a working temperature, wherein further including a temperature adjusting device for adjusting the working temperature, the temperature adjusting device setting the heating device at one of at least two working temperatures.

19 Claims, 3 Drawing Sheets

(56) References Cited

FOREIGN PATENT DOCUMENTS

| | | | |
|---|---|---|---|
| CN | 106858724 | | 6/2017 |
| CN | 107407941 | | 11/2017 |
| CN | 107510096 | | 12/2017 |
| WO | 2018227810 | A1 | 12/2018 |

* cited by examiner

ELECTRIC HEATING CIGARETTE APPLIANCE HAVING TEMPERATURE AND PERIOD ADJUSTMENT FUNCTIONS

TECHNICAL FIELD

The present disclosure relates to the technical field of novel tobacco, and in particular, to an electric heating cigarette appliance capable to adjust the temperature and the period.

BACKGROUND

Traditional cigarettes can emit smoke due to the burning of tobacco and wrappers that may occur at temperatures exceeding 800 degrees Celsius during smoking. At such high temperature, the tobacco is thermally degraded due to pyrolysis and combustion, resulting in various gaseous combustion products and fractions from tobacco, it not only produces taste and aroma, but also produces many undesirable compounds.

The existing commonly used electric heating cigarette appliances are separated and include a charging case and/or a heating rod. The charging case is used to charge the heating rod, and the smoke-forming substrate is heated by the heating rod. However, in the prior art, the heating temperature and heating period of the heating rod are fixed after the manufacture is completed, and the user cannot adjust the heating temperature and heating period of the electric heating cigarette appliance.

There is a need for low-temperature cigarettes to produce stable and comfortable smoke. However, in the electric heating cigarette appliances in prior art, it is difficult to be realized because the generation of smoke is related to the material of the substrate and the temperature of the heating substrate. The changes of the smoke-forming substrate or the heating temperature can significantly change the quality of the smoke, thereby reducing the fragrance, taste and mouthfeel experienced by the user.

In addition, even if the smoke-forming substrate does not change, the electric heating cigarette appliance with a fixed heating temperature and heating period in prior art is difficult to produce stable and comfortable smoke because of changes in ambient temperature, such as winter and summer. Due to the large change in ambient temperature, under the same heating rod working temperature and/or working period, the comfort experience of the generated smoke will also be greatly affected, thereby affecting the taste of smoking.

SUMMARY

The purpose of the present disclosure is to overcome the above-mentioned drawbacks and overcome the problem that the heating rod in the prior art only works at a constant temperature and/or in a constant heating period, so that it can work under different substrates and/or different ambient temperatures. It is provided that an electric heating cigarette appliance that provides the best stable and comfortable smoking experience.

According to an embodiment of the present disclosure, provided is an electric heating cigarette appliance that includes a power supply for providing power to a heating device, a heating device connected to the power supply, and a controller for controlling a temperature of the heating device at a working temperature, wherein further comprising a temperature adjusting device for adjusting the working temperature, the temperature adjusting device setting the heating device at one of at least two working temperatures.

According to an embodiment of the present disclosure, the electric heating cigarette appliance of the present disclosure further includes a period adjusting device for adjusting the heating period of the heating device, and the period adjusting device sets the heating period of the heating device at one of at least two working periods.

According to an embodiment of the present disclosure, the controller can take any suitable form commonly used in the art, such as a programmable microcontroller adopted to provide controlling the electric heating cigarette appliance, or application specific integrated circuits (ASIC) providing control logic for the power and operating elements contained in the electric heating cigarette appliance. Optionally, the temperature adjusting device and/or the period adjusting device may be controlled by the controller, or separate controllers may be provided for the temperature adjusting device and/or for the period adjusting device.

According to an embodiment of the present disclosure, the working temperature is continuously adjustable, or a preset discrete temperature. Optionally, the working temperatures are two, three, four or more discrete temperatures. Optionally, the working temperature is between 150 and 450 degrees Celsius, preferably between 180 and 380 degrees Celsius, more preferably 210, 230, 250, 270, 290, 310, 330, 350 or 370 degrees Celsius.

According to an embodiment of the present disclosure, the working period is continuously adjustable, or a preset discrete time period. Optionally, the working period are discrete periods of two, three, four or more than five time periods. Optionally, the working period is between 2-15 minutes, preferably between 2.5-10 minutes, and more preferably 3, 4, 5, 6, 7, 8, 9 minutes.

According to an embodiment of the present disclosure, the working temperature or the working period is stored in the controller, or stored in a separately set controller. Preferably, the temperature adjusting device or the period adjusting device is a button, a dial or a knob. The working temperature or the working period stored in the controller can be set and/or modified by the temperature adjusting device or the period adjusting device, or can be selected. Optionally, the temperature adjusting device and the period adjusting device are assembled on a button, a dial or a knob, or they may also be separate independent buttons, dials or knobs. Preferably, the working temperature and the working period can be compiled together, for example, a working temperature of 355 degrees Celsius corresponds to a working period of 5 minutes, or a working temperature of 310 degrees Celsius corresponds to a working period of 7 minutes.

According to an embodiment of the present disclosure, the electric heating cigarette appliance of the present disclosure further includes a display device to indicate the set temperatures or periods. Optionally, the display device may be any suitable device in the field, such as a display screen or an indicator light.

According to an embodiment of the present disclosure, the electric heating cigarette appliance includes at least one of a charging case or a heating rod. At least one of the heating rod or the charging case is provided with a temperature adjusting device and/or a period adjusting device. Preferably, both the heating rod and the charging case are provided with temperature adjusting devices and/or period adjusting devices. More preferably, the temperature adjusting device and/or the period adjusting device provided on the charging case can perform programming adjustment and/or control of the heating rod. The charging case can send relevant data such as signals for realizing functions to the heating rod, and the heating rod performs corresponding operations according to the identified signals and other corresponding data, so as to realize the control of the heating rod by the charging case.

According to an embodiment of the present disclosure, on an electric heating cigarette appliance that directly heats the substrate, during the working process, the working temperature and/or working period can be adjusted by the temperature adjusting device or the period adjusting device according to real-time consumption.

According to an embodiment of the present disclosure, the working temperature can be set to be constant, or it can be set to change over time during the working period, and preferably, the working temperature can be set to change over time during the working period and have a temperature curve that changes over time. Preferably, the working temperature curve of the heating device includes three stages. The first stage is a stage in which the temperature of the heating device is increased from an initial temperature to a highest temperature; the second stage is a stage in which the temperature of the heating device is reduced from the highest temperature to the working temperature. The third stage is a stage in which the temperature of the heating device is maintained at the working temperature. Preferably, the highest temperature is between 350 and 450 degrees Celsius. Preferably, the duration of the first stage is 1-25 seconds, the duration of the second stage is 1-25 seconds, and the duration of the third stage is between 118 seconds and 14 minutes and 20 seconds.

According to an embodiment of the present disclosure, the heating device may include any suitable resistive material. Suitable resistance materials include, but are not limited to: cermet heating elements, conductive ceramics, nickel-containing alloys, cobalt-containing alloys, chromium-containing alloys, aluminum alloys, titanium-containing alloys, zirconium-containing alloys, hafnium-containing alloys, niobium-containing alloys, Molybdenum alloys, tantalum-containing alloys, tungsten-containing alloys, tin-containing alloys, gallium-containing alloys, manganese-containing alloys, and iron-containing alloys. Preferably, the resistance material contained in the heating device includes tungsten, manganese, and an additive, and the additive is at least one selected from a group consisting of molybdenum, ruthenium, tellurium, germanium, and vanadium.

According to one embodiment of the present disclosure, the electric heating cigarette appliance of the present disclosure is used to heat various forms of smoke-forming substrates, such as tobacco and e-liquid. Optionally, the heating elements can take any suitable number and form. For example, there may be more than one heating device, and suitable shapes include, but are not limited to, needle, sheet, and taper.

In the present disclosure, a temperature control device that can program the heating rod is provided on the charging case, or a temperature control device, such as a temperature control key, that can be programmed independently is provided on the heating rod. The set temperature is continuous adjustable, or has more than two fixed temperature levels. In addition, a heating period control device that can program the heating rod is provided on the charging case, or a heating period control device that can be programmed independently is provided on the heating rod. Through the present disclosure, consumers can adjust the heating temperature and heating period of electronic cigarettes to adapt to different smoke-forming substrates, different external conditions, different consumption scenarios, and different smoking taste preferences, and can improve electric heating cigarette appliances versatility to different smoke generating substrates.

DESCRIPTION OF THE DRAWINGS

The accompanying drawings are used to provide a further understanding of the present disclosure, and constitute a part of the specification, together with the following specific embodiments to explain the present disclosure, but does not limit the present disclosure. In the attached figures.

DETAILED DESCRIPTION OF EMBODIMENTS

Figure 1:
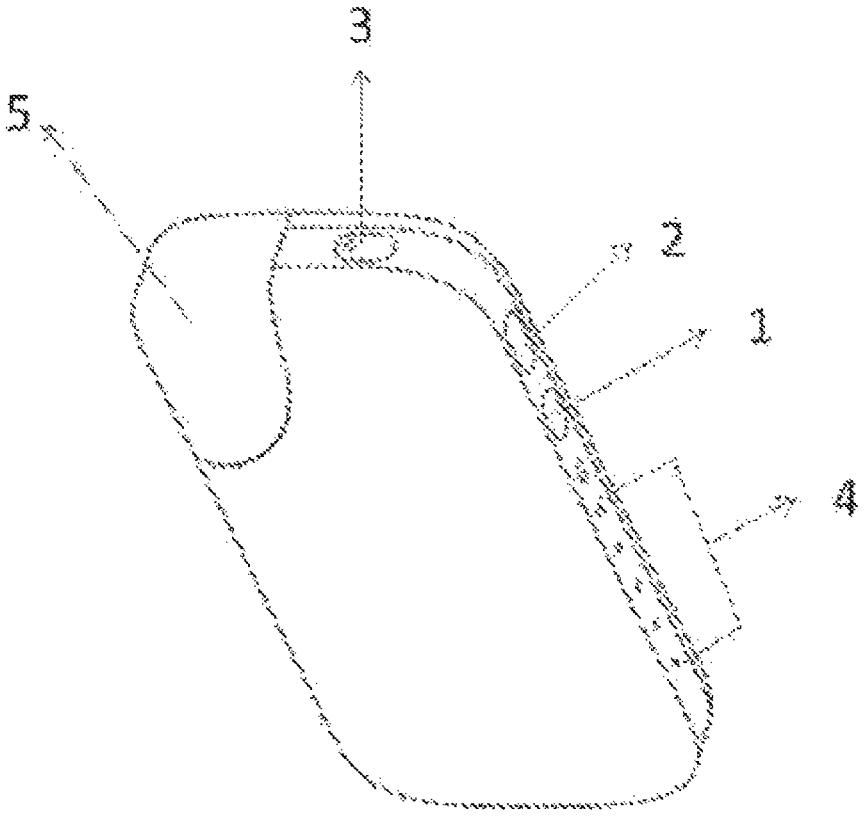
FIG. 1 is a schematic diagram showing a charging case according to an embodiment of the present disclosure.

FIG. 1 shows an exemplary illustration of the charging case according to the present disclosure. As shown in FIG. 1, the charging case may have a control device that can edit or adjust the temperature and period. The heating rod shown in FIG. 2 may be contained in the charging case. The top cover key 3 may be pressed to open the top cover 5. What is exposed in the charging case is the electronic cigarette accommodating cavity or the heating rod accommodating cavity, into which the electronic cigarette or the heating rod can be inserted. In the embodiment, the heating rod can be inserted into it. When adjusting the temperature and heating period of the heating rod through the charging case, the heating rod needs to be placed in the charging case. One of 1 and 2 can be defined as a heating period adjusting key, and the other can be defined as a heating temperature adjusting key. (Or 1 and 2 may be combined to define). In the embodiment, 1 may be a heating temperature adjusting key, and 2 may be a heating period adjusting key, both of which can be initially defined in product preparation or defined by the user. For example, after a long press the heating temperature adjusting button for 2 seconds (or pressing twice), one indicator light of indicators 4 flashes 5 times, indicating that the first working temperature is set, for example, the working temperature is 310 degrees Celsius. After a long press the heating period adjusting key for 2 seconds (or pressing twice), one indicator light of indicators 4 flashes 5 times, indicating that the first gear working period is set, for example, the working period is 6 minutes. After a long press the heating temperature adjusting button for 3 seconds (or pressing 3 times), the two indicator lights of indicators 4 flash 5 times, indicating that the setting is the second working temperature, for example, the working temperature is 330 degrees Celsius. After a long press the heating period adjusting key for 3 seconds (or pressing 3 times), the two indicator lights of indicators 4 flash 5 times, indicating that the second gear working period is set, for example, the working period is 5 minutes. After a long press the heating temperature adjusting button for 4 seconds (or pressing 4 times), the three indicator lights of indicators 4 flash 5 times, indicating that the third working temperature is set, for example, the working temperature is 350 degrees Celsius. After a long press the heating period adjusting key for 4 seconds (or pressing 4 times), the three indicator lights of indicators 4 flash 5 times, indicating that the third gear working period is set, for example, the working period is 4.5 minutes. After a long press the heating temperature adjusting button for 5 seconds (or pressing 5 times), the four indicator lights of indicators 4 flash 5 times, indicating that the fourth working temperature is set, for example, the working temperature is 370 degrees Celsius. After a long press the heating period adjusting key for 5 seconds (or pressing 5 times), the four indicator lights of indicators 4 flash 5 times, indicating that the fourth gear working period is set, for example, the working period is 4 minutes.

When the heating rod with the preset working temperature and working period is taken out, the heating rod will heat the electronic cigarette according to the preset working temperature and working period to obtain the expected taste of consumers. The comfort of suction is improved.

Figure 2:
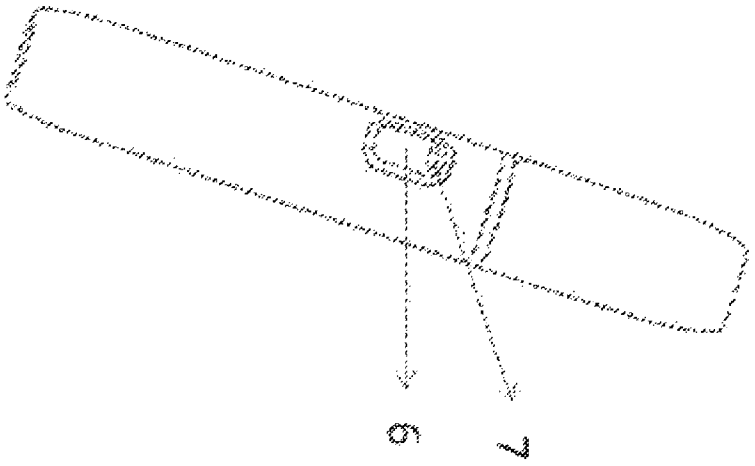
FIG. 2 is a schematic diagram showing a heating rod according to an embodiment of the present disclosure.

FIG. 2 shows an exemplary illustration of a heating rod according to the present disclosure. As shown in FIG. 2, the temperature and period adjusting device may be directly provided on the heating rod, rather on the charging case. The button 6 on the heating rod may compile the adjustments of the working temperature and the working period together, and edit or adjust the temperature and the period synchronously. The button 6 of the heating rod may have multiple functions such as program editing, switching, etc., which can be defined according to specific needs. The initial definition can be performed during product preparation, or can be defined by the user. The working temperature and working period of the heating rod can be set synchronously by defining long press or double press of the button 6. For example, after a long press for 2 seconds (or pressing twice), the indicator light 7 on the button 6 lights up once, indicating the first gear working temperature and working period are set, for example, the working temperature is 310° C. and the working period is 6 minutes. After a long press for 3 seconds (or pressing 3 times), the indicator light 7 on the button 6 will light up twice, indicating the second gear working temperature and working period are set, for example, the working temperature is 330° C. and the working period is 5 minutes. After a long press for 4 seconds (or pressing 4 times), the indicator light 7 on the button 6 lights up three times, indicating the third gear working temperature and working period are set, for example, the working temperature is 350° C. and the working period is 4.5 minutes. After a long press for 5 seconds (or pressing 5 times), the indicator light 7 on the button 6 lights up four times, indicating the fourth gear working temperature and working period are set, for example, the working temperature is 370° C. and the duty period is 4.5 minutes.

Figure 3:
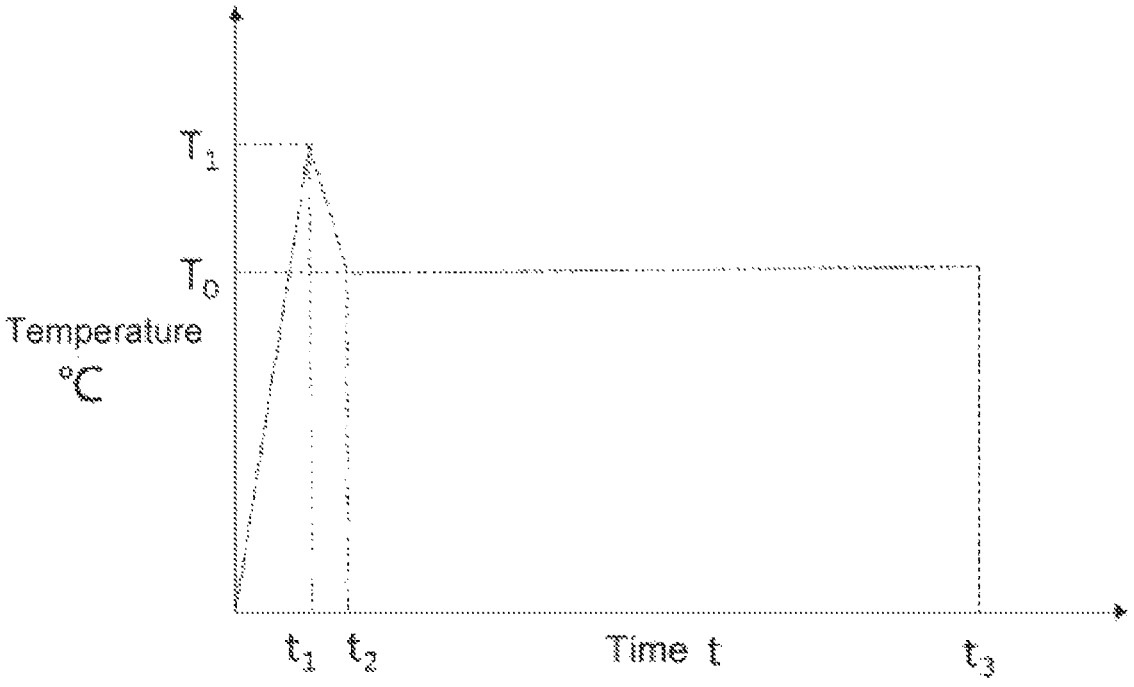
FIG. 3 illustrates a temperature curves of a heating device according to an embodiment of the present disclosure.

FIG. 3 shows a graph of the working temperature of the heating device over time during the working period. In the first stage, the temperature of the heating device rises from an initial temperature to the highest temperature T1 within t1, and t1 is in the range of 1-25 seconds, the highest temperature T1 is in the range of 220-520° C. In the second stage, the temperature of the heating device drops from the highest temperature to the working temperature T0 within t2, t2 is in the range of 1-25 seconds, and the working temperature T0 is in the range of 150-450° C., and is lower than the highest temperature T1. In the third stage, the temperature of the heating device is maintained at the working temperature T0 within t3 until the end of the working period. t3 is in the range of 118 seconds to 14 minutes and 20 seconds.

In one embodiment, t1 is set to 17 seconds, the highest temperature T1 is set to 390° C., t2 is set to 3 seconds, the working temperature T0 is set to 360° C., and t3 is set to 250 seconds.

The preferred embodiments of the present disclosure are described in detail above, but the present disclosure is not limited to the specific details in the aforesaid embodiments. Various simple modifications can be made to the technical solution of the present disclosure within the scope of the technical concept of the present disclosure, and these simple modifications all fall within the protection scope of the present disclosure.

In addition, it should be understood that the various specific technical features described in the aforesaid specific embodiments can be combined in any suitable manner without contradiction. In order to avoid unnecessary repetition, the various possible combinations are not described separately in the present disclosure.

The invention claimed is:

1. An electric heating cigarette appliance, comprising:

a power supply for providing power to a heating device, the heating device connected to the power supply, a controller for controlling a temperature of the heating device at a working temperature, a temperature adjusting device for adjusting the working temperature, the temperature adjusting device setting the heating device at one of at least two working temperatures, and a period adjusting device for adjusting a heating period of the heating device, wherein the period adjusting device sets the heating period of the heating device at one of at least two working periods.

2. The electric heating cigarette appliance according to claim 1, wherein the working temperature is continuously adjustable or preset.

3. The electric heating cigarette appliance according to claim 1, wherein the working period is continuously adjustable, or wherein the at least two preset working periods are preset.

4. The electric heating cigarette appliance according to claim 1, wherein the temperature adjusting device is a button, a dial or a knob.

5. The electric heating cigarette appliance according to claim 1, wherein the period adjusting device is a button, a dial or a knob.

6. The electric heating cigarette appliance according to claim 1, wherein the temperature adjusting device and the period adjusting device are assembled on a button, a dial or a knob.

7. The electric heating cigarette appliance according to claim 1, wherein a number of the working temperatures is three or four, and a number of the working periods is three or four.

8. The electric heating cigarette appliance according to claim 1, wherein the controller is a programmable microcontroller.

9. The electric heating cigarette appliance according to claim 1, wherein the temperature adjusting device is capable to be adjusted in real time during an operation of heating a substrate when the temperature adjusting device is placed on the heating appliance directly heating the substrate.

10. The electric heating cigarette appliance according to claim 1, wherein the working temperature is between 150 and 450 degrees Celsius.

11. The electric heating cigarette appliance according to claim 10, wherein the working period is between 2-15 minutes.

12. The electric heating cigarette appliance according to claim 1, further comprising a display device configured to indicate a set temperature or period.

13. The electric heating cigarette appliance according to claim 12, wherein the display device is a display screen or an indicator light.

14. The electric heating cigarette appliance according to claim 1, wherein the electric heating cigarette appliance comprises a charging case and a heating rod.

15. The electric heating cigarette appliance according to claim 14, wherein the charging case is capable to control the heating rod.

16. The electric heating cigarette appliance according to claim 1, wherein values of the working temperatures have a temperature curve that changes over time.

17. The electric heating cigarette appliance according to claim 16, wherein the temperature curve comprises three stages: a first stage is a stage in which the temperature of the heating device is raised from an initial temperature to a highest temperature; a second stage is a stage in which the temperature of the heating device is reduced from the highest temperature to the working temperature; a third stage is a stage in which the temperature of the heating device is maintained at the working temperature.

18. The electric heating cigarette appliance according to claim 17, wherein the highest temperature is between 350 and 450 degrees Celsius.

19. The electric heating cigarette appliance according to claim 17, wherein a duration of the first stage is 1-25 seconds; a duration of the second stage is 1-25 seconds; and a duration of the third stage is between 118 seconds and 14 minutes and 20 seconds.

* * * * *